US005273377A

United States Patent [19]

Taylor

[11] Patent Number: 5,273,377

[45] Date of Patent: Dec. 28, 1993

[54] ROOF BOLT

[76] Inventor: Alton E. Taylor, 2175 Rainwater La., Hanson, Ky. 42413

[21] Appl. No.: 982,957

[22] Filed: Nov. 30, 1992

[51] Int. Cl.[5] ..... E21D 20/02

[52] U.S. Cl. ..... 405/259.6; 405/259.5

[58] Field of Search ..... 405/259.1, 259.5, 259.6, 405/259.2, 259.3, 259.4, 262; 411/82

[56] References Cited

U.S. PATENT DOCUMENTS

| | | | |
|---|---|---|---|
| 3,108,443 | 10/1963 | Schuermann et al. | 405/259.6 |
| 3,901,319 | 8/1975 | Staley | 405/259.6 X |
| 3,940,941 | 3/1976 | Libert et al. | 61/45 |
| 4,140,428 | 2/1979 | McLain et al. | 405/259.6 |
| 4,303,354 | 12/1981 | McDowell, Jr. | 405/261 |
| 4,386,877 | 6/1983 | McDowell et al. | 405/261 |
| 4,518,282 | 5/1985 | Wilcox et al. | 405/302.1 |
| 4,636,115 | 1/1987 | Davis et al. | 405/259 |
| 5,073,065 | 12/1991 | Kleineke | 405/259 |

OTHER PUBLICATIONS

Frazer & Jones, Mine Roof Support Anchors (date unknown).

*Primary Examiner*—David H. Corbin

*Attorney, Agent, or Firm*—Senniger, Powers, Leavitt & Roedel

[57] ABSTRACT

A roof bolt comprising a bar with a plurality of tabs at locations on the bar spaced longitudinally thereof, the tabs projecting radially outwardly from the bar. In the use of the roof bolt, the bolt is inserted into a hole drilled in a roof of an underground passage and anchored in the hole by resin adhesive held in a bag inserted into the hole prior to the insertion of the roof bolt. The roof bolt punctures the bag upon insertion into the hole and is rotated about its longitudinal axis to facilitate setting the resin adhesive for anchoring the roof bolt in the hole. The tabs thoroughly blend the resin adhesive upon rotation of the bar thereby improving the bond of the resin adhesive to the bolt. The tabs also engage the hardened resin adhesive to provide a support for loads directed generally outwardly of the opening.

19 Claims, 2 Drawing Sheets

ROOF BOLT

BACKGROUND OF THE INVENTION

This invention relates generally to mining roof bolts and, more particularly, to a roof bolt adapted to be anchored within a bore in the mine roof by resin adhesive material.

The existing roof bolts, such as shown, for example, in U.S Pat. No. 3,940,941, comprise a rod, usually formed of metal bar stock of the type used to reinforce concrete ("rebar"). Installation of the bolt in the roof of a mine includes the steps of: drilling a bore in the roof, inserting charges of unmixed resin therein, inserting the rod into the bore, mixing the resin by rotating the rod and, in a "fully grouted" system, continuing the application of pressing force until the resin has hardened thereby securing the rod to the roof. In "point anchored" and simultaneous "point anchored" and "fully grouted" bolting systems, such as shown, for example, in U.S. Pat. No. 4,303,354, only enough fast setting resin is provided in the bore to secure the bolt at its upper end and along the upper portion of its length to the surfaces of the roof defining the bore. The bolt may be three or more feet long, a relatively long lower portion of the length is then ungrouted (for "point anchored" bolt system) or filled with a slow setting resin (for simultaneous "point anchored" and "fully grouted" bolt system). Rotating the nut after the fast setting resin in the upper portion of the bore hardens with the nut pressing up against a roof bolt plate, but before the slow setting resin of the simultaneous "point anchored" and "fully grouted" system has hardened, tensions the lower portion of the bolt and effects a clamping or compressing of the roof strata between the hardened fast setting resin and the roof plate.

The existing roof anchoring bolts in the "fully grouted", "point anchored", and simultaneous "point anchored" and "fully grouted" bolting systems provide insufficient mixing of the resin upon rotation of the bolt to achieve the desired degree of homogenization of the resin. The incomplete mixing of the resin components upon hardening of the resin results in a lower than optimal bonding of the resin.

Among the several objects and features of the present invention may be noted the provision of a roof bolt for anchorage in a hole in the roof of a mine which is capable of quickly and thoroughly blending the resin adhesive; the provision of such a bolt which has increased load supporting capacity; the provision of such a roof bolt which can be formed by modifying commercially available resin bonded bolts; the provision of such a bolt which can be readily installed in the roof of the mine by standard roof bolting machines; and the provision of such a roof bolt which is of relatively simple and inexpensive construction.

Generally, the roof bolt of the present invention is adapted to be inserted into a hole drilled in a roof of an underground passage. The bolt is to be anchored in the hole by resin adhesive held in a bag inserted into the hole prior to the insertion of the roof bolt. The roof bolt punctures the bag upon insertion into the hole, and then the bolt is rotated about its longitudinal axis to facilitate setting the resin for anchoring the roof bolt in the hole. The roof bolt comprises a bar and a plurality of tabs on the bar at locations spaced longitudinally thereof. The tabs project radially outwardly from the bar for thoroughly blending the resin adhesive upon rotation of the bar thereby improving the bond of the resin adhesive to the bolt and for providing a support against loads directed generally outwardly of the hole.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 4:
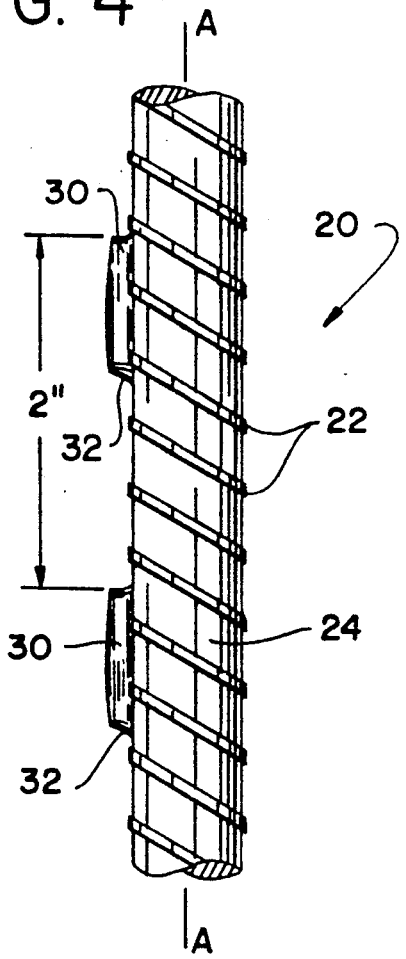
FIG. 4 is a side elevation of the roof bolt showing the tabs attached thereto.
Figure 5:
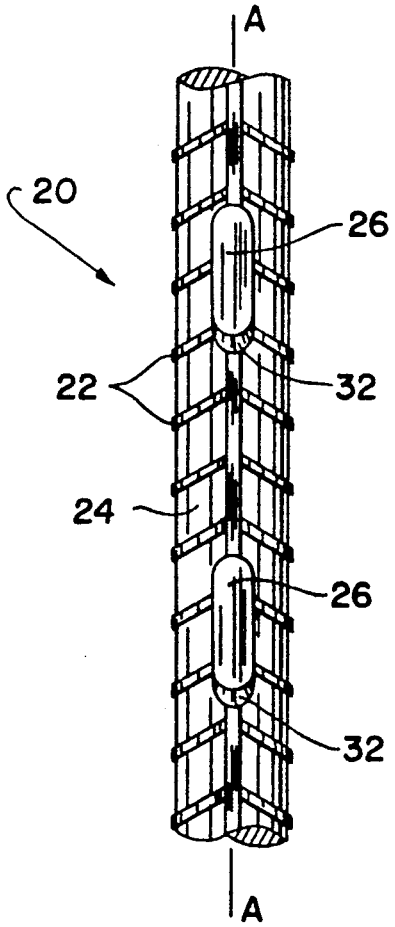
FIG. 5 is a plan view of the bolt with the tabs attached thereto.

Referring now to the drawings, a roof bolt constructed according to the principles of this invention for supporting a roof in a mine is indicated generally at 20. Like conventional resin anchored bolts, the bolt 20 may be formed of metal bar stock of the type used to reinforce concrete (i.e. "rebar") having a pattern of ridges 22 on its surface. The roof bolt 20 comprises a bar 24 with a plurality of tabs 26 on the bar 24 at locations spaced longitudinally thereof at approximately 2 inch intervals as indicated in FIG. 4. It has been found that an approximate 2 inch spacing of the tabs 26 produces particularly good blending of the resin 28. However, it is to be understood that the tabs 26 may have other spacing and still fall within the scope of this invention. Each tab 26 projects radially outwardly from the bar 24 and comprises a substantially flat lead mixing face 30 which contacts and displaces the resin adhesive 28 upon rotation of the bolt 20 about its longitudinal axis A for thoroughly blending the resin adhesive 28 thereby improving the bond of the resin 28 to the bolt 20. The tab 26 has a generally downward facing surface 32 lying in a plane oblique to the actual longitudinal axis A of the bolt and inclining radially outwardly from the bar 24. The surface 32 is adapted to engage the hardened resin adhesive 28 to provide a support for the bolt 20 against loads directed generally outwardly of the bore B.

The roof bolt 20 is adapted to be inserted into a hole B drilled in a roof of a mine, generally indicated at R. The roof bolt 20 is anchored in the hole B by resin 28 inserted into the hole B prior to the insertion of the roof bolt 20. The resin 28 is typically a two-component charge (not shown in the figs.), preferably comprising a polyester resin material as one component and a peroxide hardener as the other, such as the product sold under the name Quickset Type 'B' by DuPont de Nemours & Co. The charge of resin components 28 is sufficient in amount to provide enough resin 28 to fill whatever space there may be at the upper end of the bore 36 above the upper end of the bolt 38 and at least part of the annular space 40 surrounding the bolt 20 when fully inserted in the bore B. The resin components are packaged in a breakable, plastic two-compartment package 34 resembling a sausage. The components are separately encased in the package 34 to keep the components isolated until the package 34 is ruptured by the bolt 20 when the bolt 20 is inserted into the bore B. Once the package 34 is ruptured, the components flow together and begin to harden. However, without mixing, the components do not blend together so thoroughly as to harden the resin 28 as rapidly and uniformly as desirable.

Shortly after the insertion of the bolt 20 into the bore B or, preferably, simultaneous with the insertion, the bolt 20 is rotated for mixing the two components of the resin 28. Such rotation is effected by means of the drill element of a conventional roof bolting machine (not shown), the bolt 20 being spun rapidly (i.e. 200–250 rpm) for about three seconds. In the illustrated embodiment, the roof bolt 20 is threaded at an end of the bar 42 protruding from the hole B, and includes a nut 44 which is threadable onto the end of the bar 42 and a bearing plate 50.

The tabs 26 on the bar 24 of the bolt 20 project radially outwardly from the bar 24, and each tab 26 has a substantially flat lead mixing face 30 which displaces the unmixed components in the annular space 40 upon rotation of the bolt 20 about its longitudinal axis A. The rapid dispersion of the components in the annular space 40, due to the rotation of the tabs 26, thoroughly and quickly blends the components resulting in a substantially homogeneous resin mixture 28. The homogenized resin 28 hardens quickly and provides a stronger bond of the resin 28 to the roof bolt 20 as compared to previous bonds of the resin to the bolts without the tabs. The bolt 20, when fully inserted in the bore B, is positioned substantially all the way up to the upper end of the bore, generally indicated at 36, to minimize the amount of resin 28 between the upper end of the bolt 38 and the upper end of the bore 36 where thorough mixing of the components by rotating the bolt 20 is difficult.

After the components 28 have been thoroughly mixed, the rotation of the bolt 20 is stopped and the bolt 20 is held from below a few more seconds (e.g., 8–12 seconds) while the material 28 is allowed to harden in place in the bore B around the bolt 20, thereby securing the bolt 20 in the bore B. The tabs 26 on the bar 24 of the bolt 20 each have a generally downward facing surface 32. The generally downward facing surface 32 engages the hardened resin 28 to provide support for the bolt 20 against loads directed generally outwardly of the hole. Consequently, the roof bolt 20 provides an increased load supporting capacity over conventional bolts. The increased load supporting capacity enables the roof bolt 20 to be utilized in further mining operations, such as a support for cable hangers 46.

The improved roof bolt 20 of the present invention—the Taylor Tab bolt—was tested against a standard resin bolt by anchoring both bolts into one inch diameter bores drilled in the roof of a mine. The improved bolt tested was the above-described preferred embodiment comprising a single row of tabs spaced along the longitudinal axis of the bolt at two inch intervals. The improved bolt was spun for three seconds and allowed to set for approximately eight seconds. The standard resin bolt was anchored into the bore following the anchoring procedures for standard resin bolts. As the Table indicates, the standard resin bolt was pulled out of the hole under a load of approximately 29,000 psi. The improved bolt, however, was never pulled from the hole and the test was discontinued at a load of 41,000 psi.

TABLE 1

The Improved "Taylor Tab" bolt v. Standard Resin Bolt

| Load (psi) | Taylor Tab (Inches of deflection) | Standard (Inches of deflection) |
|---|---|---|
| 8,000 | .005 | .005 |
| 26,000 | .021 | .070 |
| 28,000 | .022 | .110 |
| 30,000 | .025 | **** |
| 35,000 | .030 | **** |
| 41,000 | .038 | **** |

**** indicates that the bolt was pulled from the hole.
Note: Both bolts were #5 × 36"

Figure 1:
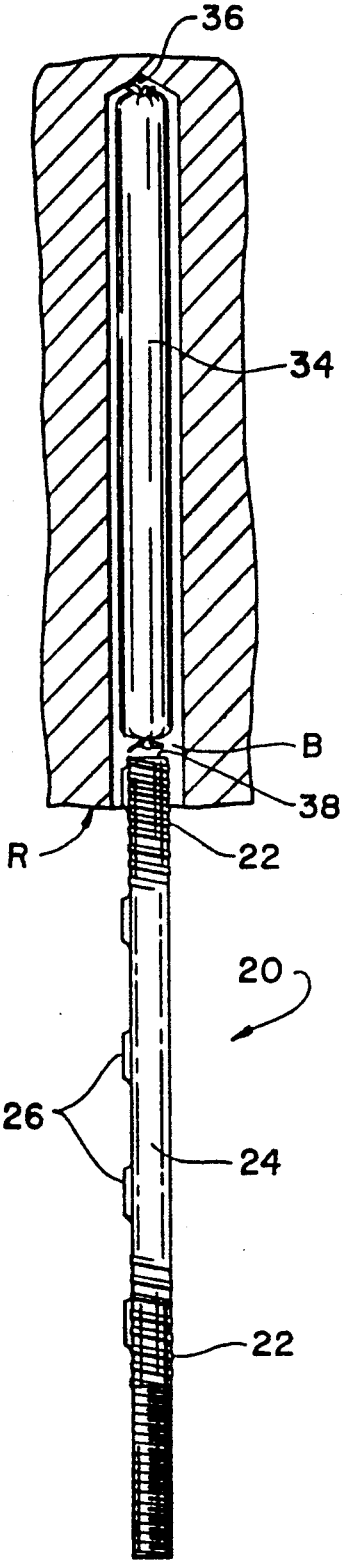
FIG. 1 is a fragmentary section through a bore in the roof of a mine showing the package of resin components therein and the improved roof bolt of this invention as initially inserted in the bore.
Figure 2:
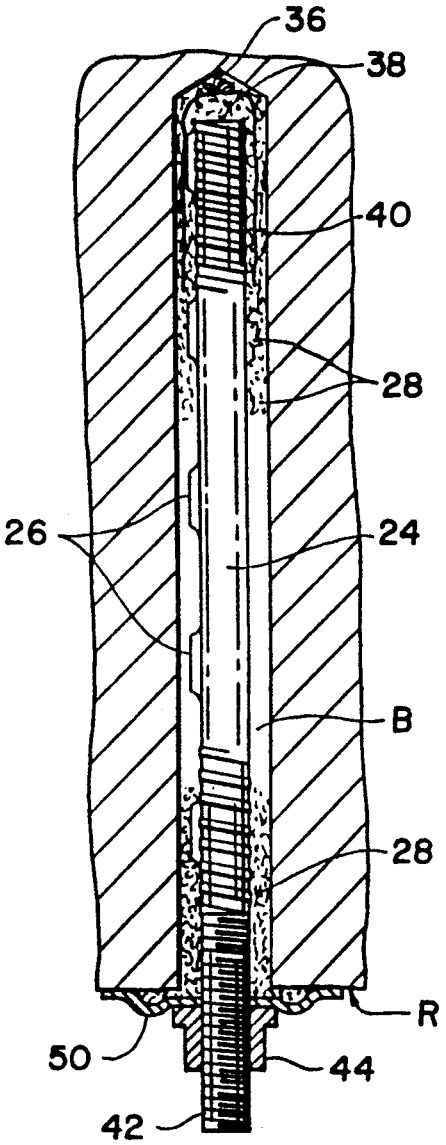
FIG. 2 is a fragmentary section similar to FIG. 1 showing the roof bolt fully inserted into the bore with the resin surrounding the roof bolt.
Figure 3:
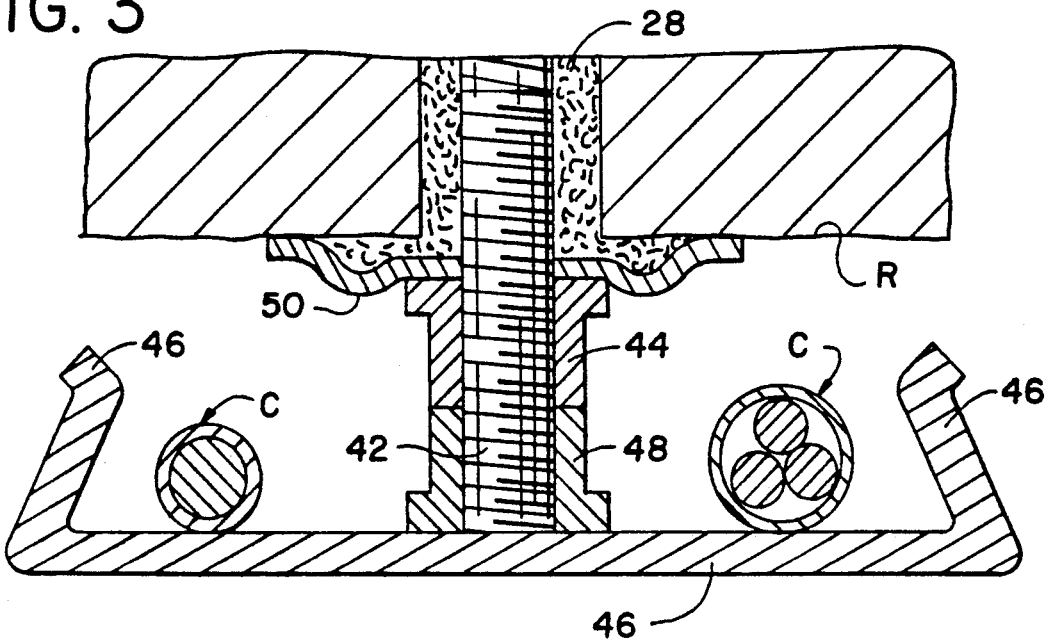
FIG. 3 is a fragmentary section showing the roof bolt in a fully inserted position and a cable hanger attached to the threaded end of the bolt extending from the bore.

As illustrated in FIG. 3, the roof bolt 20 is adapted to support a cable hanger 46 for holding cable, generally indicated at C, along the roof R of the mine. The threaded outer end of the bolt 42 protrudes a distance sufficient to permit the nut 44 and spacer 48 of the cable hanger 46 to be rotatably connected to the roof bolt 20. After the cable hanger 46 is connected to the roof bolt 20, the cable C can be supported by the hanger 46.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A roof bolt adapted to be inserted into a hole drilled in a roof of an underground passage, and to be anchored in the hole by resin adhesive held in a bag inserted into the hole prior to the insertion of the roof bolt, the roof bolt puncturing the bag upon insertion into the hole and being rotated about its longitudinal axis to facilitate setting the resin adhesive for anchoring the roof bolt in the hole, the bolt comprising a unitary bar having a length substantially at least as great as the depth of the hole in the roof, a portion of the bar being received in the hole upon insertion of the bolt therein, a plurality of tabs on the bar at locations spaced longitudinally of the bar at intervals along substantially the entire portion of the bar received in the hole, the tabs projecting radially outwardly from the bar for thoroughly blending the resin adhesive along substantially the full depth of the hole upon rotation of the bar thereby improving the bond of the resin to the bolt and for providing support against loads directed generally outwardly of the hole.

2. A roof bolt as set forth in claim 1 wherein the tabs each have a generally downward facing surface for engagement with the hardened resin adhesive thereby supporting the bolt against loads directed generally outwardly of the hole.

3. A roof bolt as set forth in claim 2 wherein the generally downward facing surface lies in a plane oblique to the central longitudinal axis of the bolt and inclining radially outwardly of the bar.

4. A roof bolt as set forth in claim 1 wherein the outwardly projecting tabs each have a substantially flat lead mixing face lying in a plane generally perpendicular to the direction of rotation of the bolt about its longitudinal axis, the mixing face displacing the resin adhesive upon rotation of the bolt for facilitating the homogenization of the resin adhesive.

5. A roof bolt as set forth in claim 1 wherein the tabs are spaced at intervals of one-half inch or greater.

6. A roof bolt as set forth in claim 5 wherein the tabs are spaced at intervals of 4 inches or less.

7. A roof bolt as set forth in claim 1 wherein the tabs are spaced at approximately 2 inch intervals.

8. A roof bolt as set forth in claim 1 wherein the bolt further comprises a cable hanger adapted for connection to the bar and disposed outside the hole for supporting cable and the like from the roof.

9. A full grouted mine roof bolting system comprising a resin adhesive-filled bag and a bolt, the bolt comprising a unitary bar, a plurality of tabs on the bar at locations spaced longitudinally thereof, the bolt being adapted for insertion into a hole drilled in a roof of an underground passage, the ar having a length substantially at least as great as the depth of the hole in the roof such that a portion of the bar is received in the hole upon insertion of the bolt therein, the tabs being disposed at intervals along substantially the entire length of the portion of the bar received in the hole, the bar being adapted to be anchored in the hole by resin adhesive held in the bag inserted into the hole prior to the insertion of the roof bolt, the roof bolt puncturing the bag upon insertion into the hole and being rotated about its longitudinal axis to facilitate setting the resin adhesive for anchoring the roof bolt in the hole, the tabs projecting radially outwardly from the bar for thoroughly blending the resin along substantially the full depth of the hole adhesive upon rotation of the bar thereby improving the bond of the resin adhesive to the bolt and for providing supporting against loads directed generally outwardly of the hole.

10. A mine roof bolting system as set forth in claim 9 wherein the labs each have a generally downward facing surface for engagement with the hardened resin adhesive thereby supporting the bolt against loads directed generally outwardly of the hole.

11. A mine roof bolting system as set forth in claim 10 wherein the generally downward facing surface lies in a plane oblique to the central longitudinal of the bolt and inclining radially outwardly of the bar.

12. A mine roof bolting system as set forth in claim 9 wherein the outwardly projecting tabs each have a substantially flat lead mixing face lying in a plane generally perpendicular to the direction of rotation of the bolt about its longitudinal axis, the mixing face displacing the resin adhesive upon rotation of the bolt for facilitating the homogenization of the resin adhesive.

13. A mine roof bolting system as set forth in claim 9 wherein the tabs are spaced at intervals of one-half inch or greater.

14. A mine roof bolting system as set forth in claim 13 wherein the tabs are spaced at intervals of 4 inches or less.

15. A mine roof bolting system as set forth in claim 9 wherein the tabs are spaced at approximately 2 inch intervals.

16. A mine roof bolting system as set forth in claim 9 wherein the bolt further comprises a cable hanger adapted for connection to the bar and disposed outside the hole for supporting cable and the like from the roof.

17. A roof bolt adapted to be inserted into a hole drilled in a roof of an underground passage, and to be anchored in the hole by resin adhesive held in a bag inserted into the hole prior to the insertion of the roof bolt, the roof bolt puncturing the bag upon insertion into the hole and being rotated about its longitudinal axis to facilitate setting the resin adhesive for anchoring the roof bolt in the hole, the bolt comprising a bar, a plurality of tabs on the bar at locations spaced longitudinally thereof at approximately 2 inch intervals, the tabs projecting radially outwardly from the bar and comprising a substantially flat lead mixing face which contacts and displaces the resin adhesive upon rotation of the bolt about its longitudinal axis for thoroughly blending the resin adhesive thereby improving the bond of the resin adhesive to the bolt, and a generally downward facing surface for providing support against loads directed generally outwardly of the hole.

18. A roof bolt as set forth in claim 17 wherein the bolt further comprises a cable hanger adapted for connection to the bar and disposed outside the hole for supporting cable and the like from the roof.

19. A roof bolt as set forth in claim 17 wherein the tabs are spaced at said 2 inch intervals in a single row along the entire length of a portion of the bar received in the hole upon insertion of the bolt therein, the bar having a length greater than the depth of the hole.

* * * * *